United States Patent [19]

Bone

[11] Patent Number: 4,687,409

[45] Date of Patent: Aug. 18, 1987

[54] ARTICLE HANDLING APPARATUS

[75] Inventor: James Bone, Cumbria, United Kingdom

[73] Assignee: Vickers Shipbuilding and Engineering Limited, Barrow-in-Furness, United Kingdom

[21] Appl. No.: 745,299

[22] Filed: Jun. 14, 1985

[30] Foreign Application Priority Data

Jun. 15, 1984 [GB] United Kingdom ..... 8415295

[51] Int. Cl.[4] ..... B65G 25/02

[52] U.S. Cl. ..... 414/750; 89/33.1; 198/741; 198/772; 221/224

[58] Field of Search ..... 414/750, 267, 276; 198/740, 741, 772; 221/224; 89/33.05, 33.1, 46

[56] References Cited

U.S. PATENT DOCUMENTS

| | | | |
|---|---|---|---|
| 2,604,820 | 7/1952 | Schiff | 89/33.05 |
| 2,940,582 | 6/1960 | Boros | 198/740 X |
| 2,993,411 | 7/1961 | Goldsmith | 89/33.1 X |
| 3,331,281 | 7/1967 | Jafvert | 89/33.1 |

FOREIGN PATENT DOCUMENTS

| | | | |
|---|---|---|---|
| 59419 | 1/1942 | Denmark | 89/33.1 |
| 349920 | 12/1960 | Switzerland | 198/740 |

*Primary Examiner*—Robert J. Spar
*Assistant Examiner*—Stuart J. Millman
*Attorney, Agent, or Firm*—Mason, Kolehmainen, Rathburn & Wyss

[57] ABSTRACT

There is disclosed article handling apparatus (10) which is primarily intended for transferring ammunition shells to and from a storage magazine in a mobile weapons system such as a tank or warship. The apparatus comprises a storage magazine having a storage rack on which the articles can be stored, and an indexing-type conveyor for traversing the articles along the storage rack. The conveyor moves through an indexing cycle in which it has a starting position in which it is engageable with a first batch of articles, causes one increment of traversing movement of the batch, releases itself from the engaged first batch, returns to the starting position and engages with a second batch of articles. A restrainer is provided, including a cam bar, which operates to locate any articles which may be present on the storage rack against up and down movement and also against traversing movement while the apparatus is in its storage mode. In addition, the cam bar retains the articles in position in the storage rack while the conveyor is returning to its starting position during operation of the apparatus in the transfer mode.

8 Claims, 5 Drawing Figures

ARTICLE HANDLING APPARATUS

FIELD OF THE INVENTION

This invention relates to article handling apparatus for use with a succession of articles of generally similar shape and size, the apparatus being operable in a storage mode to store the articles and being operable in a transfer mode to transfer the articles to and from storage respectively from or to article loading and unloading stations.

The invention has been developed primarily, though not exclusively, in relation to the handling of articles which are fragile and/or prone to move easily by themselves, so that positive locationing is required at all times. Apparatus according to the invention can be used to handle articles of regular, or irregular shape, provided that all of the articles to be handled have generally the same shape and size.

Equipment for the handling of articles is well known in production lines, bottling plants and the like. Often belts or a series of rollers will perform the conveying function quite adequately. However, in other cases, cradles or trolleys are used where a specific orientation is demanded. Such equipment is sometimes not suitable, if the articles to be handled have a tendency to move easily e.g. balls or rollers and/or if the handling equipment is itself subject to unpredictable motion. Examples of the latter situation are where the equipment is installed on a moving vehicle or a ship. In such situations, there is a need for a mechanism to precisely move articles a predetermined distance, while ensuring that positive locationing of the articles is maintained at all times.

SUMMARY OF THE INVENTION

According to the invention there is provided article handling apparatus for use with a succession of articles of generally similar shape and size, the apparatus being operable in a storage mode to store the articles and being operable in a transfer mode to transfer the articles to and from storage respectively from or to article loading and unloading stations, and comprising:

a storage magazine having a storage rack on which the articles can be stored;

indexing means operable, when the apparatus is operating in its transfer mode, simultaneously to traverse articles relative to the storage rack while positively locating the articles against undesired movement in the traversing plane, the indexing means being movable through an indexing cycle in which it has a starting position in which it is engageable with a first batch of articles (one or more articles), causes one increment of traversing movement of the batch, releases itself from the engaged first batch, returns to the starting position and engages with a second batch of articles;

and restraining means for locating any articles which may be present on the storage rack against first, generally up and down movement, and also second, traversing movement relative to the rack while the apparatus is in its storage mode, and also while the indexing means is returning to its starting position during operation of the apparatus in its transfer mode.

Preferably, the restraining means is arranged to be able to locate the articles in all directions, except that in which said articles are to be traversed by the indexing means when the latter is operating.

Apparatus according to the invention is particularly suitable for use in situations in which articles must be securely located against any movement in a magazine, during the article storage mode of the apparatus, and in which there must be restraint against up and down movement during traversing movement of the articles. Particular examples of such use are where the apparatus itself is mounted in an installation which is liable to sudden movement, such as vehicles or marine vessels. The apparatus is especially, though not exclusively, suitable for the storage and transfer of ammunition e.g. shells, in which for obvious reasons it is very important that there should be as secure as possible locationing of the ammunition.

The references to "up and down movement" (first movement) of the articles is relative to the storage rack. When the rack takes up a generally horizontal position, the up and down movement which is prevented will be a generally vertical movement. However, it should be understood that there may be situations in which the rack is non-horizontal, and may even be vertical, either because of a fixed arrangement of the rack in a stationary piece of apparatus or because of a temporary position taken up by the apparatus when the latter is mounted fixedly in a mobile environment e.g. a vehicle or marine vessel. Therefore, the reference to "up and down movement" should be understood as referring to movement in a plane generally perpendicular to the extent of the rack i.e. to the direction of traversing movement along the rack.

In one preferred embodiment, the restraining means includes an arrangement of restraining members which are fixed relative to the magazine and which locate the articles against first (up and down) movement in the storage and also in the transfer modes of the apparatus. The restraining means may also include a movable restraining member which locates the articles against second (traversing) movement of the articles while the apparatus is in the storage mode, and also during the phase of the transfer mode in which the indexing means is returning to its starting position, and is therefore unable to locate the articles.

Evidently, during engagement of an article by an indexing means, when the article is caused to traverse along the storage rack, the article will be located by the indexing means against first and/or second movement.

Conveniently, the indexing means comprises a pawl arrangement which is engageable with one, or a series of articles, forming a first batch, and is operable to transfer the first batch by one increment relative to the magazine. The pawl arrangement then disengages from the first batch, returns to the starting position and engages with a further batch of articles.

The traversing movement of a batch of articles may be from a loading station and into the storage rack, along the storage rack, or from the storage rack to an unloading station.

The pawl arrangement preferably comprises a pawl bar which is suitably shaped, in conformance with the external profile of the articles, in order to be able to engage and locate, and traverse the articles.

The fixed restraining members may comprise a pair of spaced guides between which the articles are movable, preferably in the form of upper and lower (relative to the storage rack) guide rails. The movable restraining member may comprise a cam bar which is operated in synchronised relationship with the operation of the pawl bar. Thus, when the pawl bar is engaging the batch of articles, the cam bar will be disengaged, and vice versa.

However, in another embodiment, there is a different arrangement of restraining means in which restraining members are provided which locate the articles against first movement in the storage and in the transfer modes of the apparatus, but also operate to locate the articles against second movement while the apparatus is in the transfer mode. The restraining members may again comprise a pair of spaced-apart guides (rails) between which batches of articles are located against first movement in the storage mode, but the guides may also be arranged so as to be able to locate the batch of articles against second (traversing) movement when the pawl bar is disengaged. A suitable arrangement of the guides may be provided by spring-loading of at least one guide rail, and/or the provision of frictional surfaces on at least some of the guide rails.

The apparatus may be arranged to be power driven, or manually operated, and therefore is provided with an appropriate drive train to operate the apparatus in its transfer mode. Preferably, the drive train is operable in a "forward" or "reverse" mode, depending upon whether article loading or unloading is required.

According to a particularly preferred embodiment of the invention, there is provided apparatus for positively locating and conveying articles of a substantially similar shape and size and comprising:

1. restraining member(s) for locating said articles in a first plane;

2. restraining member(s) for locating said articles in a second plane at right angles to said first plane;

3. a fixed restraining member(s) operating in conjunction with two movable restraining members for locating and moving said articles in a third plane at right angles to said first and second planes such that, of said two movable restraining members, the first movable restraining member initially locates said articles while simultaneously moving them a predetermined distance in said third plane and subsequently releases said articles, returns to its original position, before relocating with said articles while the second movable restraining member initially releases said articles and subsequently relocates with said articles;

Wherein said first movable restraining member moves according to the first locus of a first point of a linking member, said first locus being defined by the interaction of the two separate loci of two other points on said linking member such that of said two separate loci, one is defined by a closed loop and the other is defined by a reciprocating linear or curvi-linear path;

wherein said second movable restraining member is movable along a path in which it alternately locates with said articles and releases said articles; and wherein the motions of said first and second movable restraining members are in antiphase (180° out of phase) with each other so that said first movable restraining member is locating said articles while said second movable restraining member has released said articles and vice versa.

Preferably, the first and second movable restraining members are bars provided to locate with (a part of) said articles. The two separate loci may be an oblong loop and a straight line with two curved end portions.

According to a modification of the particularly preferred embodiment, any/all of the restraining members locating in said first, second or third planes may be biased, or provided with frictional surfaces to provide a positive restraining force onto the articles, to adequately locate said articles during the period when said first movable restraining member has released them. In this case, only a single movable restraining member would be required, i.e. only said first movable restraining member.

One example of article handling apparatus according to the invention will be described in relation to the handling of shells in the magazine of a ship or tank, in which the articles (shells) are basically cylindrical and therefore prone to roll easily, while the ship or tank may be subject to random motion requiring the shells to be positively located at all times. Such a method of handling is commonly known as indexing.

DESCRIPTION OF PREFERRED EMBODIMENT

Figure 2:
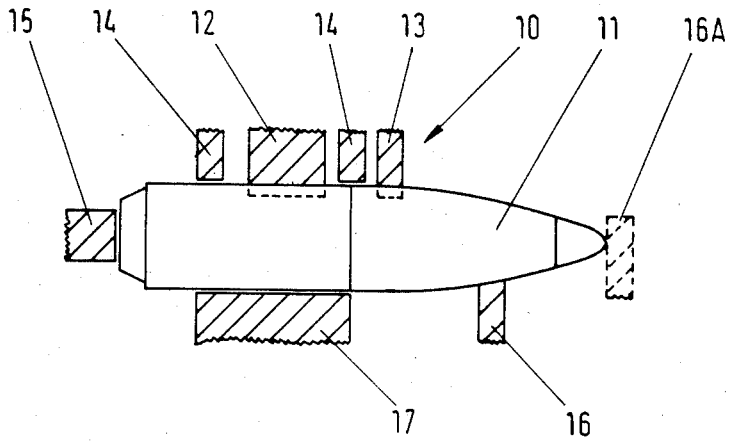
FIG. 2 is a first angle projection showing side elevations in more detail of an indexing mechanism of the apparatus.

Referring now to the drawings, there is shown article handling apparatus, designated generally by reference numeral 10, for use in storing a succession of ammunition shells 1, 11 on a storage rack of a magazine, and for transferring the shells along the rack, and to and from shell loading and unloading stations. It should be understood that the apparatus is shown somewhat schematically in the drawings, but will be constructed so as to be suitable for storage and transfer of ammunition shells of the type used by tank or naval guns. The storage rack for the shells will be formed partly, as shown in FIG. 2, by upper rails 14, lower rails 17, front rail 16 or 16A, and rear rail 15.

As will be described in more detail below, indexing means is provided which is operated, when the apparatus is operating in its transfer mode, to traverse the shells relative to the storage rack, the indexing means being movable through an indexing cycle in which it has a starting position in which it is engageable with a batch of shells (one or more shells), causes one increment of traversing movement of the batch, releases itself from the engaged batch and returns to the starting position. Further, as described in more detail below, restraining means is provided for locating shells which are present on the storage rack against first, generally up and down movment, and also second, traversing movement relative to the rack while the apparatus 10 is operating in its storage mode. In addition, the restraining means provides the same locationing function while the indexing means is returning to its starting position during operation of the apparatus in its transfer mode.

Figure 1:
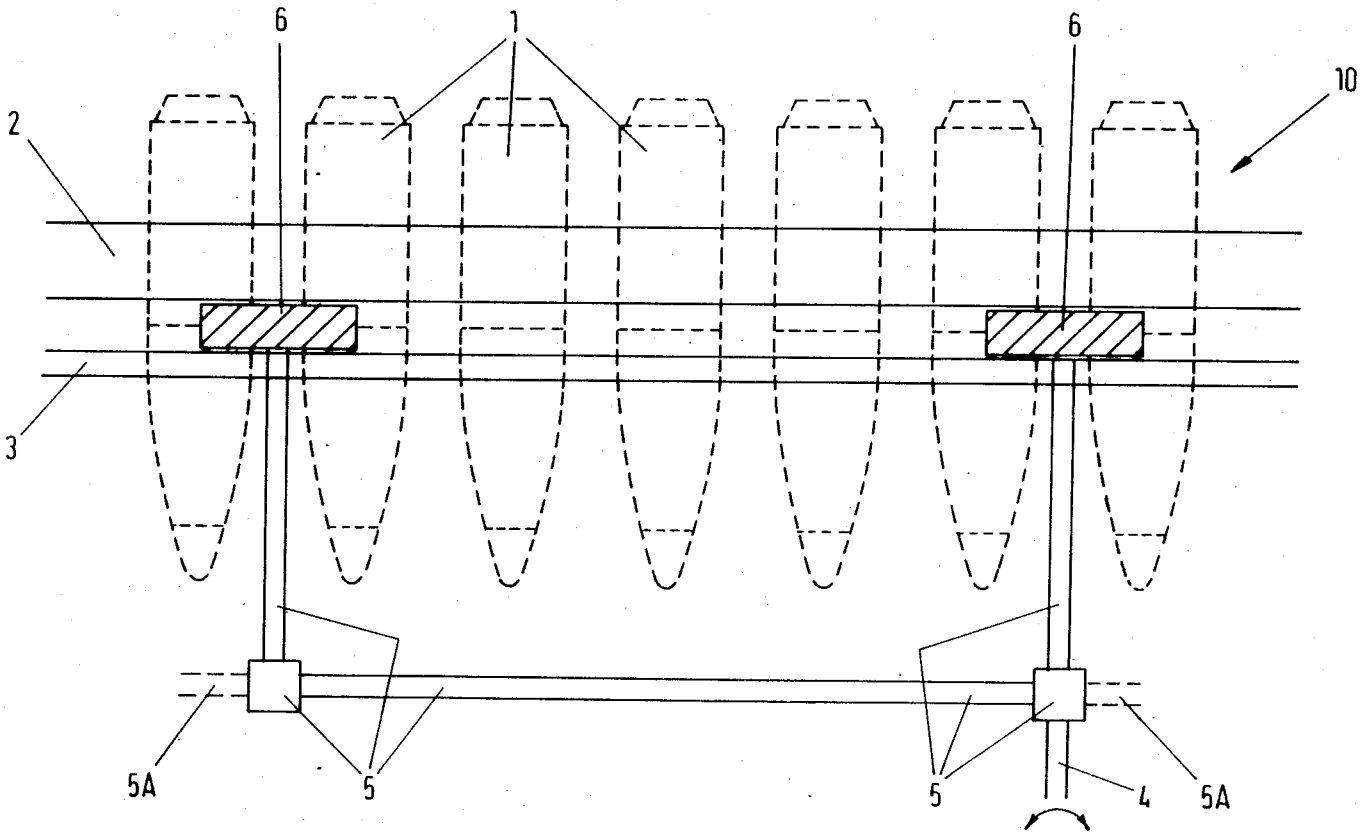
FIG. 1 is a diagrammatic plan view of an article handling apparatus according to the invention.

Referring now to FIG. 1, there is shown schematically, and in plan view, part of the apparatus 10, in which each shell 1 of a magazine is positively located by either or both of a pawl bar 2 and a cam bar 3, which are each engageable with the upper surfaces of the shells 1. Rotary motion may be applied, either by a manual or power drive, to an input shaft 4. The rotary motion is transferred via a drive train 5, comprising drive shafts and gearboxes, to two or more indexing gearboxes 6 which control the motion of the pawl bar 2 and the cam bar 3.

The indexing gearboxes 6 convert the input rotary motion to a form of reciprocating motion, to move both pawl bar 2 and cam bar 3 in antiphase with each other. For example, pawl bar 2 is raised clear of a batch of shells 1, moved, say, to the right by a distance equal to that separating any two adjacent shells, i.e. the "pitch", and then lowered to re-engage with the shells in the magazine, then moved back to the left transporting all the shells one position leftwards; as the pawl bar 2 starts to move leftwards, cam bar 3 is lifted clear to allow the shells to move underneath and when this movement is completed, cam bar 3 is lowered to locate positively the shells in the magazine again. Thus, the raising and lowering of pawl bar 2 and cam bar 3 are in antiphase.

The pawl bar 2 is shown only schematically in FIG. 1, and a more detailed construction of pawl bar (12), forming the indexing means of the apparatus, will be described in more detail with reference to FIGS. 2, 2A and 2B. Similarly, the detailed construction of the cam bar 3, which forms a movable restraining member, will be described with reference to the cam bar (13) of FIGS. 2, 2A and 2B.

Meanwhile, continuing with FIG. 1, the drive train for operating the apparatus, in addition to input shaft 4 and drive shaft and gear boxes 5, may include extension drive shafts 5A, shown dotted, whereby the mechanism may be extended as far as required. Furthermore, a second magazine and associated indexing mechanism may be placed adjacent to the first and both operated by the single input shaft 4.

The indexing mechanism can be operated in one direction to feed shells automatically for storage in a magazine (formed by the mechanism) when the shells are fed to a loading station at one end of the mechanism. The mechanism can then be operated subsequently in an opposite direction, to feed the shells to an unloading station (which may be the same as the loading station) at which a gun-loading device (not shown) is provided in order to feed shells to the breech of a gun.

Referring now to FIG. 2, the construction of the indexing mechanism is shown in more detail, and shows how shells 11 are positively located by pawl bar 12 and cam bar 13 (corresponding to bars 2 and 3 in FIG. 1). As referred to above, the upper rail 14 and lower rail 17 provide locationing for the shells 11 in that they form restraining means which prevents first, up and down movement of the shells relative to the storage rack. When the storage rack extends substantially horizontally, this up and down movement which is prevented will be generally vertical movement. However, the rails 14 and 17 also function as guides during traversing movement of the shells 11 under the action of the indexing means (pawl bar 12). Forward and rearward movement of the shells 11 i.e. movement to the right or left, is prevented by the front and rear rails 16 (or 16A) and 15 respectively. Suitable frictional facing material may be placed on the surfaces of all/any of the rails 14, 15, 16, 17 to assist with the prevention of movement of the shells, in undesired directions.

Figure 2A:
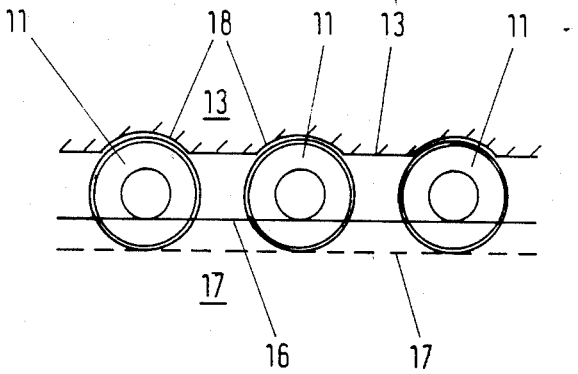
FIGS. 2A and 2B are end elevations showing parts of the indexing mechanism of FIG. 2 in more detail.
Figure 2B:
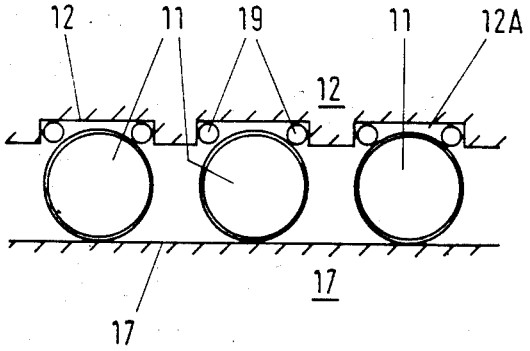

As will be seen from FIG. 2A, movement in a third traversing plane is prevented by scalloped cutouts 18 provided in the cam bar 13, when the latter engages the shells 11. Resilient or spring-loaded pads may be incorporated into the scalloped cutouts 18 to allow for any size variation of the articles (shells) being handled. FIG. 2B shows that on the pawl bar 12, small rollers 19 (or low friction pads) are used inside cut-out 12*a* to locate the shells 11; the use of rollers 19 facilitates lateral movement of the shells which roll along lower rails 17 when the pawl bar 12 is moved.

One position for forward rail restraint for some articles is as shown by rail 16A. However, for shells which have a fuse at the tip, rail 16 is a safer location in this particular application.

Figure 3:
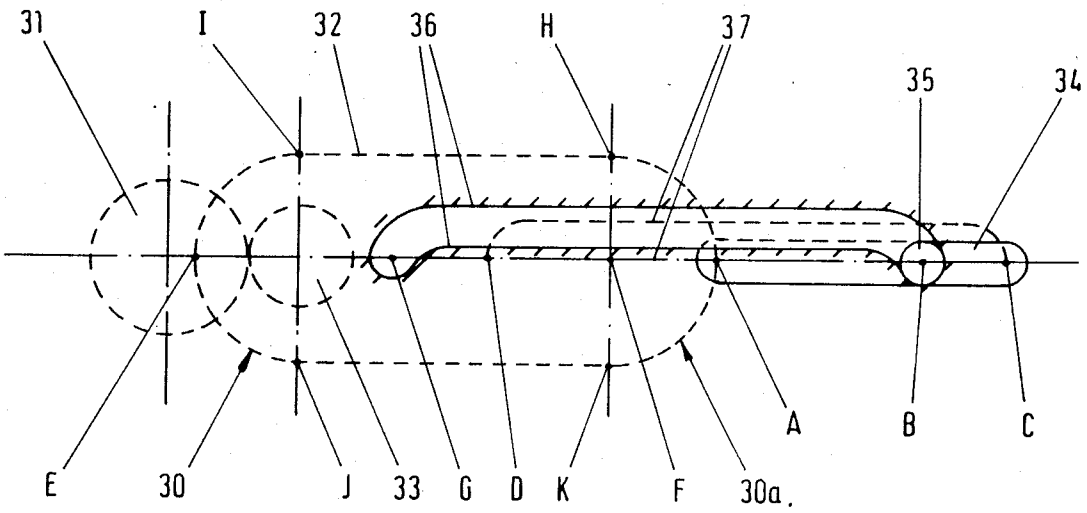
FIG. 3 is a diagram showing the principle of operation of the indexing mechanism.

The description of the operation of an indexing cycle of the indexing means (pawl bars 2 or 12) will now be described with reference to FIG. 3. Thus, there is shown how an indexing gearbox 6 transmits drive to the pawl bar 12 and the cam bar 13. Rotary motion from drive shaft 4, via shafts 5 (FIG. 1), enters each indexing gearbox 6 onto a chain sprocket 30. For clarity, only the lefthand half of the sprocket 30 is indicated by the dashed semi circle. A second chain sprocket 30*a* (again only half shown for clarity) is centered on point F. An endless roller chain 32 encompasses the two chain sprockets 30, 30*a*, following an oblong track (defined by dashed lines) which passes through points A, H, I, E, J, K.

At point A, a driving link 34 is pivotally connected to the roller chain 32; thus as roller chain 32 moves, so point A of the driving link follows the oblong track. At point B on the driving link 34, a roller 35 is pivotally mounted which engages in a cam track 36. Hence, the loci of movement of the two points A and B on the driving link 35 are defined by the oblong track of chain 32 and the cam track 36 respectively. A point C at the trailing end of the driving link 34 is pivotally connected to the pawl bar (2, 12).

The operation of the gearbox will now be described, assuming that input chain sprocket 30 is rotated counterclockwise from the position shown in FIG. 3, causing the roller chain 32 to move counterclockwise around its oblong track. Point A starts to move along its locus upwards and to the left. This causes point B to move in the same direction within the constraints of its locus (cam track 36). The relative geometry of the loci of A and B is such that point C moves leftwards along the dash-dot straight line part A, B, C of its path of motion 37. As sprocket 30 continues to rotate and A passes point H, the driving link 34 continues to move leftwards at an essentially constant angle until, when A reaches point I, both A and B start to move downwards as defined by their respective loci. When A reaches point E, B will have reached point G and C will have reached point D.

As A moves past E, it starts to move downwards and to the right. Point B cannot move downwards, but can move upwards and to the right. This combination of movements causes C to leave point D following the upper curved dashed line part of path 37. As A moves between J and K, the driving link moves rightwards at an essentially constant angle (though a different angle than that previously mentioned) and from K to A, the driving link returns to the position shown in FIG. 3, as roller 35 reaches the end of cam track 36.

Thus, as A follows the locus A, H, I, E, J, K, A, follows the locus B, G, B causing C to move along locus C, B, A, F, D, C—as shown by path 37. The important feature of the locus 37 of C is that it moves horizontally to the left (C, B, A, F, D), upwards, horizontally to the right and then downwards (see upper run of track 37).

Input chain sprocket 30 carries a coaxial gear wheel 33 which meshes with gear wheel 31. Gear wheel 31 drives a simple cam mechanism acting against a spring(s) (not shown) which causes cam bar 3, 13 to reciprocate vertically in antiphase with the motion of the pawl bar 2, 12.

The connection between the movements of the indexing gearbox mechanism and the pawl and cam bars 12, and 13 respectively will now be explained:

As A moves from A to H, cam bar 13 is raised vertically via gearing 33, 31 thus freeing the shells 11 from the scalloped cutouts 18 (FIG. 2A). At the same time C (attached to the pawl bar) starts to move pawl bar 2, 12 to the left with the rollers 19 (FIG. 2B) acting on the shells, causing them to roll and move to the left. As A moves from H to I, the cam bar remains raised and pawl bar 12 continues leftwards. From I to E, the pawl bar 12 reaches the limit of its leftward movement and cam bar 13 desends so that the scalloped cutouts 18 re-engage with the shells 11. As A moves from E via J and K back to A, the cam bar 13 remains permanently in the down (engaged) position while pawl bar 12 is raised (to free rollers 19 from engagement with the shells 11) moved to the right by one increment of shell spacing-apart and then lowered to effect re-engagement. The lateral movement of C corresponds to the shell pitching in the magazine 1 (FIG. 1). At positions A and E, both pawl bar 12 and cam bar 13 are in the down (engaged) position. Depending on the shape of the articles being handled, slight adjustments may be made to the actual positions at which the pawl and cam bars engage and release, as required, i.e. the motions of the pawl and cam bars may not be exactly in antiphase. Indeed, periods of dwell may be introduced into the cycle to provide a sufficient overlap between the motions of the pawl and cam bars, to ensure positive location at all times.

It would be normal practice for two (or more) indexing gearbox mechanisms to be provided, one at each end of the pawl bar, to be used together to ensure parallel motion of the pawl and cam bars. The mechanism may be used in the manner described i.e. to move shells from right to left, or in the reverse direction, i.e. to move shells from left to right, simply by reversing the direction of the input drive 4. Thus, the mechanism may be used to load a magazine and subsequently unload it, or transfer shells from a store to the breech of a gun. Magazines may be linked end-to-end and driven by the same input shaft 4, if required with the shells being transferred either directly or indirectly between magazines.

In the illustrated embodiment, the cam bar 3, 13 functions as a movable restraining member to locate the shells against unintended traversing movement (tending to be caused for example, by a violent movement of the vehicle or vessel in which the indexing mechanism is mounted) during the periods when the pawl bar 2, 12 is carrying out its return movement to its starting position (out of engagement with the shells) and prior to descending into engagement with a further batch of shells. This further batch will, of course, be the same as a previously engaged batch, except that there will be one less at one end and one more at the opposite end.

However, the use of a cam bar (3, 13) is not essential to this invention and a further embodiment (not shown) dispenses with the need for the cam bar and relies on alternative means to prevent unintended traversing movement of the shells when the pawl bar is out of engagement with the shells. Conveniently, this is provided by arranging for the upper and lower rails 14, 17 to exert together a stronger clamping action on the shells. This may be achieved by providing spring-loading of one or both of the rails and/or by providing frictional facing materials on at least some of the rails, so as to generate sufficient restraining forces to locate the shells (against traversing movement) when the pawl bar is out of engagement with the shells.

The described embodiments of the invention provide a solution to conveying problems, whereby articles of a similar shape and size may be handled and moved in a precise manner, while all the articles being conveyed are positively located at all times. Though the conveying of shells has been described, by way of example, other shaped articles are equally acceptable, provided that scalloped cutouts 18 (and the equivalent in the pawl bar) are shaped to conform with that of the article being conveyed. For articles which are not intended, or able, to roll, lower rail 17 could consist of a series of rollers. The described embodiments also provide the following advantages:

1. Positive, repeatable, bi-directional movement and location of articles from a single reversable rotary input.
2. There is no permanent mechanism extending above the receiving/donating position for indexed articles.
3. No mechanism (permanent or transient) is provided which extends beyond the receiving/donating station, permitting modules to be positioned adjacent to each other, using a common central receiving/donating position whilst maintaining minimal pitch of the articles.

I claim:

1. Shell handling apparatus which is operable in a storage mode to store the shells and in a transfer mode to transfer the shells to and from storage respectively from or to shell loading and unloading stations, which apparatus comprises a storage magazine having a storage rack on which the shells can be stored, conveying means for traversing the shells along the storage rack when the apparatus is operating in its transfer mode, and restraining means shaped so as to be capable of locking the shells relative thereto and thereby positively locating the shells on the storage rack, in which:

the conveying means comprises indexing means engageable with the shells and operable, in the transfer mode of the apparatus, to roll the shells along the storage rack, wherein the indexing means (a) is movable through an indexing cycle in which (i) it has a starting position in which it is engageable with a first batch of shells, consisting of one or more shells, (ii) it causes one increment of traversing movement of the batch, (iii) it releases itself from the engaged first batch, (iv) it returns to the starting position, and (v) it engages with a second batch of shells; and (b) comprises a pawl arrangement which positively locates the shells relative thereto, during traversing of the shells along the storage rack, the pawl arrangement comprising a pawl bar having cut-outs in which the shells are located and which include rollers or low friction pads to permit rotation of the shells during traversing of the latter along the storage rack; and the restraining means operable to locate any shells which may be present on a storage rack against first, generally up and down movement and also second, traversing movement relative to the storage rack while the apparatus is in its storage mode, and also while the indexing means is returning to a starting position during operation of the apparatus in its transfer mode.

2. Apparatus according to claim 1, in which the restraining means comprises a cam bar having cut-outs shaped to correspond with the shape of the shells.

3. Apparatus according to claim 2, including a pair of fixedly spaced guides between which the shells are movable.

4. Apparatus according to claim 3, in which the fixed guides comprise upper and lower guide rails.

5. Apparatus according to claim 1, in which the restraining means comprises a cam bar having cut-outs shaped to correspond with the shape of the shells, said cam bar being operated in synchronised relationship with the operation of the pawl bar, whereby when the pawl bar engages the first batch of shells, the cam bar is disengaged, and vice versa.

6. Apparatus according to claim 5, including a drive mechanism which is coupled with the pawl bar and with the cam bar in order to effect synchronised operation thereof.

7. Apparatus according to claim 6, in which the drive mechanism includes a drive link which is coupled with the pawl bar, and a cam track which guides the movement of the drive link in order to effect an indexing cycle of the pawl bar.

8. Apparatus according to claim 7, including a single and reversible input drive to the drive mechanism.

* * * * *